US006726355B2

(12) United States Patent
Li Preti et al.

(10) Patent No.: US 6,726,355 B2
(45) Date of Patent: Apr. 27, 2004

(54) SELF-CLEANING MIX HEAD HAVING A LONGITUDINAL MIXER FOR A MOLDING SYSTEM

(75) Inventors: Alfredo Li Preti, Toronto (CA); Andrej Petricko, Toronto (CA)

(73) Assignee: Mirolin Industries Corporation (CA)

( * ) Notice: Subject to any disclaimer, the term of this patent is extended or adjusted under 35 U.S.C. 154(b) by 197 days.

(21) Appl. No.: 10/028,459

(22) Filed: Dec. 20, 2001

(65) Prior Publication Data

US 2003/0117889 A1 Jun. 26, 2003

(51) Int. Cl.[7] ..... B01F 7/20

(52) U.S. Cl. ..... 366/172.1; 366/189; 366/325.92; 422/133; 422/135; 422/225; 425/200

(58) Field of Search ..... 366/162.4, 162.5, 366/168.1, 172.1, 189, 194, 195, 325.92, 325.93, 336, 337, 341; 416/236 R; 222/148, 229, 235, 256, 260, 133, 135, 225, 226; 425/200, 207

(56) References Cited

U.S. PATENT DOCUMENTS 2,831,606 A * 4/1958 Alters ..... 222/1
3,005,399 A * 10/1961 Lisbon ..... 99/348
3,012,977 A * 12/1961 Wilson et al. ..... 521/172
3,373,906 A * 3/1968 De Hart et al. ..... 222/235
3,608,976 A * 9/1971 Zugelder et al. ..... 406/97
4,441,857 A * 4/1984 Jackson et al. ..... 415/206
5,071,040 A * 12/1991 Laptewicz, Jr. ..... 222/235
5,842,786 A * 12/1998 Solomon ..... 366/139
6,367,962 B1 * 4/2002 Mizutani et al. ..... 366/189
6,390,661 B1 * 5/2002 Bellasalma et al. ..... 366/162.3
6,527,431 B2 * 3/2003 Chen et al. ..... 366/159.1
6,536,936 B1 * 3/2003 Bellasalma et al. ..... 366/138
2002/0176317 A1 * 11/2002 Bellasalma et al. ..... 366/182.4

FOREIGN PATENT DOCUMENTS

WO WO 90/05584 * 5/1990

* cited by examiner

*Primary Examiner*—Tony G. Soohoo
*Assistant Examiner*—David L. Sorkin
(74) *Attorney, Agent, or Firm*—Carlson, Gaskey & Olds

(57) ABSTRACT

A mix head assembly including a mix chamber having a mixer rotatably mounted therein. The mixer extends for a longitudinal length and defines a multiple of vanes which agitate the fluid material components as the mixer is rotated. A plunger is movably mounted in the mix chamber relative to the mixer. As the plunger is driven relative the mixer, the plunger scrapes the fluid material off the mixer such that no remnants remain within the mix chamber.

15 Claims, 4 Drawing Sheets

SELF-CLEANING MIX HEAD HAVING A LONGITUDINAL MIXER FOR A MOLDING SYSTEM

BACKGROUND OF THE INVENTION

The present invention relates to a mixing chamber for a molding system, and more particularly to a longitudinal mixer which minimizes the requirement of flushing.

A typical molding system provides for the mixing of at least two fluid materials to form a settable mixture which is discharged into a mold cavity to form a finished article. One particular mixture includes three fluid material components which form a matrix having a catalyst, a matrix polymer and a foaming agent. The fluid materials are typically fed from a supply by a delivery or feed assembly which communicates with a mixing head. The fluid materials are mixed by the mixing head and discharged into the mold cavity to form the molded article.

Once mixed in the mix head the fluid material components gels and then becomes hard in a relatively timely fashion. It is therefore essential to cleanse the mixing head of any residual material to prevent the remnants from hardening within. Typically, the mix head is flushed after each cycle to remove the remnants and prepare the mix head for the next injection cycle. This is time consuming and expensive as the flushing fluid must be safely disposed of after usage.

Accordingly, it is desirable to provide a mix head which minimizes the necessity of flushing between injection cycles to decrease the cycle time for production and expense of each finished article.

SUMMARY OF THE INVENTION

The present invention provides a mix head assembly including a substantially tubular mix chamber. A mixer is rotatably mounted within the mix chamber which defines an axis. The mixer extends for a longitudinal length along the axis and defines a multiple of vanes which extend substantially perpendicular to the axis. Each of the vanes includes a plurality of steps which agitate the fluid material components as the mixer is rotated.

A plunger is movably mounted in the mix chamber for movement along the axis. The plunger defines an outer diameter which closely fits within the mix chamber and an inner configuration which closely fits over the mixer. As the plunger is driven along the axis, the plunger cleans any fluid material remnants from the mixer. That is, the plunger scrapes the fluid material off the mixer such that no remnants remain within the mix chamber. The necessity of flushing between injection cycles is therefore eliminated as the plunger need only be cycled up and down. Cycle time for production and expense of each finished article is thereby decreased.

The present invention therefore provides a mix head which minimizes the necessity of flushing between injection cycles to decrease the cycle time for production and expense of each finished article.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
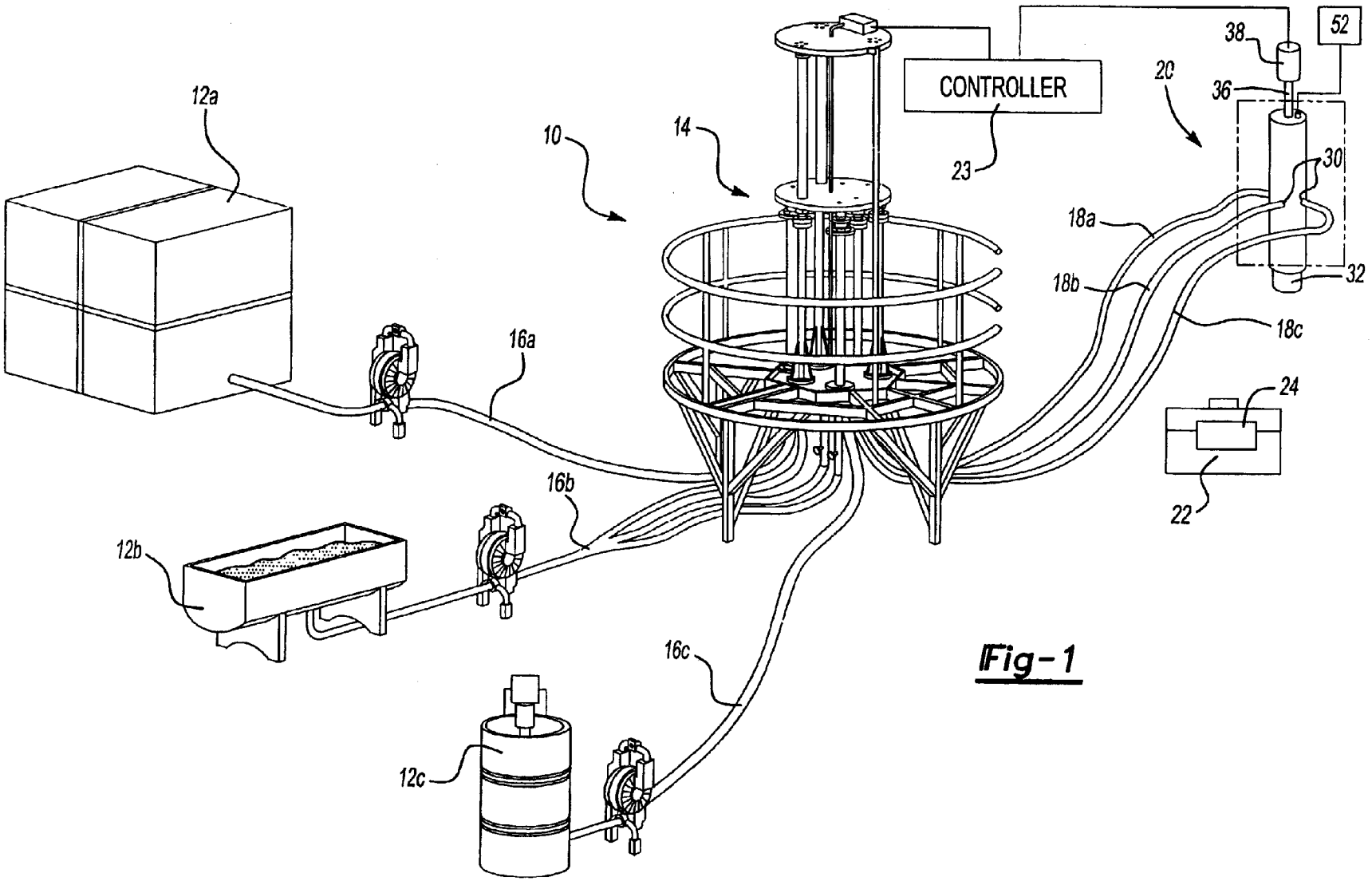
FIG. 1 is a simplified schematic representation of a multiple material molding system having a valve assembly designed according to the present invention.

FIG. 1 schematically illustrates a multiple material molding system 10. The system 10 generally includes a plurality of fluid material supplies 12A, 12B and 12C, which communicate with a feed assembly 14 through respective supply conduits 16A–16C. The feed assembly 14 drives a desired quantity of fluid material from each fluid material supply 12A–12C through output conduits 18A–18C to a mix head assembly 20. The mix head assembly 20 thoroughly mixes the fluid material from each fluid material supply 12A–12C and injects the final mixture into a mold assembly 22 or the like. Preferably, a controller 23 communicates with the feed assembly 14 and the mix head assembly 20 to assure the system 10 is operating within predefined parameters. Controls for injection-molding equipment are known in the art and further description of the algorithms will not be further detailed herein.

The mix head assembly 20 mixes the multiple of fluid materials components e.g., fluid material matrix, to form a hardenable or settable mixture which is then discharged into a mold cavity 24 of the mold assembly 22. Typically, a single mix head 20 feeds the matrix into a multiple of mold assemblies which are arranged in an assembly line like environment. The matrix begins to set upon mixture and the mix head assembly 20 according to the present invention minimizes matrix remnants within the mix head assembly 20 such that the mix head assembly 20 need not be flushed after each cycle injection.

Figure 2:
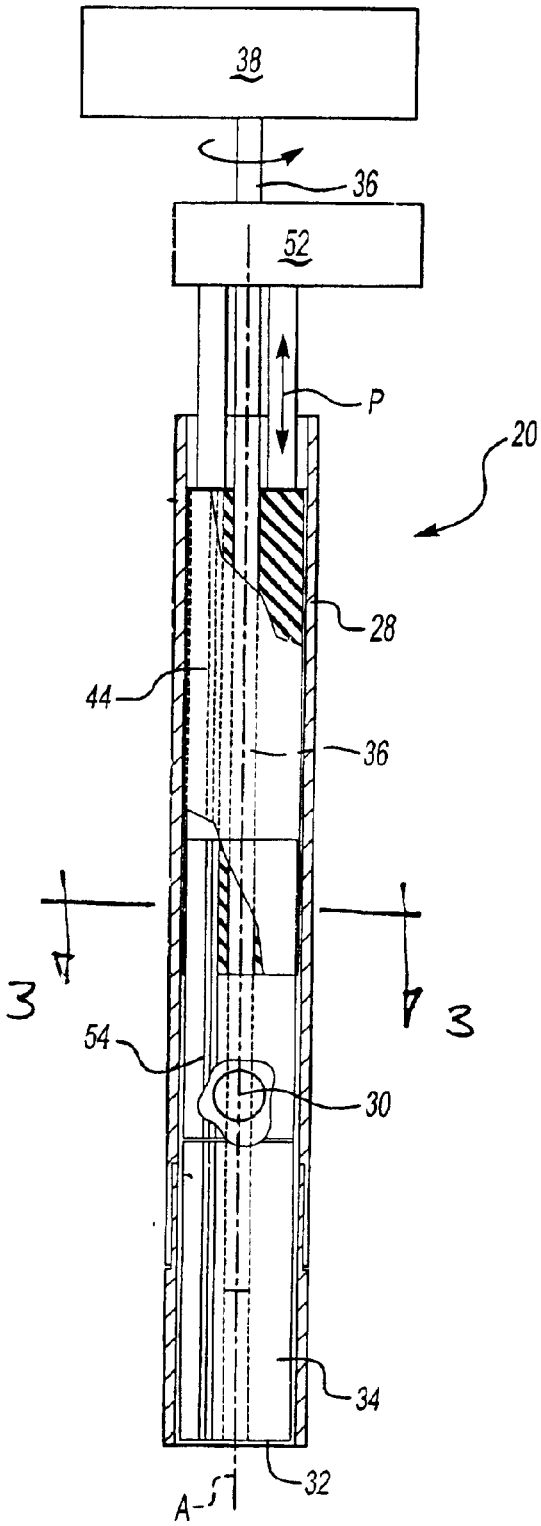
FIG. 2 is an expanded partial sectional view of a mix head assembly in a returned position.

Referring to FIG. 2, a partial sectional view of the mix head assembly 20 according to the present invention is illustrated. The mix head assembly 20 includes a substantially tubular mix chamber 28 which defines an axis A. The mix chamber 28 defines an input port 30 and an output port 32. A multiple of input ports are preferably radially arranged around the mix chamber 28 such that a multiple of fluid material components are simultaneously received therein from the feed assembly 14 (FIG. 1). It should be understood that although only a single input port arrangement is disclosed in the illustrative embodiment, many input port arrangements will benefit from the present invention. The output port 32 preferably includes a coupler valve mechanism (not shown) which provides for the attachment of the mix head assembly 20 to the mold assembly 22 and selective opening and closing thereof.

A mixer 34 (also illustrated in FIGS. 3 and 4) is rotatably mounted within the mix chamber 28. A drive shaft 36 mounted along axis A is attached to the mixer 34. A drive assembly (illustrated schematically at 38) preferably rotates the drive shaft 36 to rotatably drive the mixer 34 in response to the controller 23 (FIG. 1.) The drive assembly 38 is preferably an electric motor, however, various other drive assemblies will also benefit from the present invention. The drive assembly 38 rotates the drive shaft 36 such that the mixer 34 is rotated about the axis A.

The mixer 34 extends for a longitudinal length along axis A and defines a multiple of vanes 40 (also illustrated in FIG. 3) which extend substantially perpendicular to the axis A. The vanes 40 preferably continuously extend along the entire longitudinal length of the mixer 34.

Figure 3:
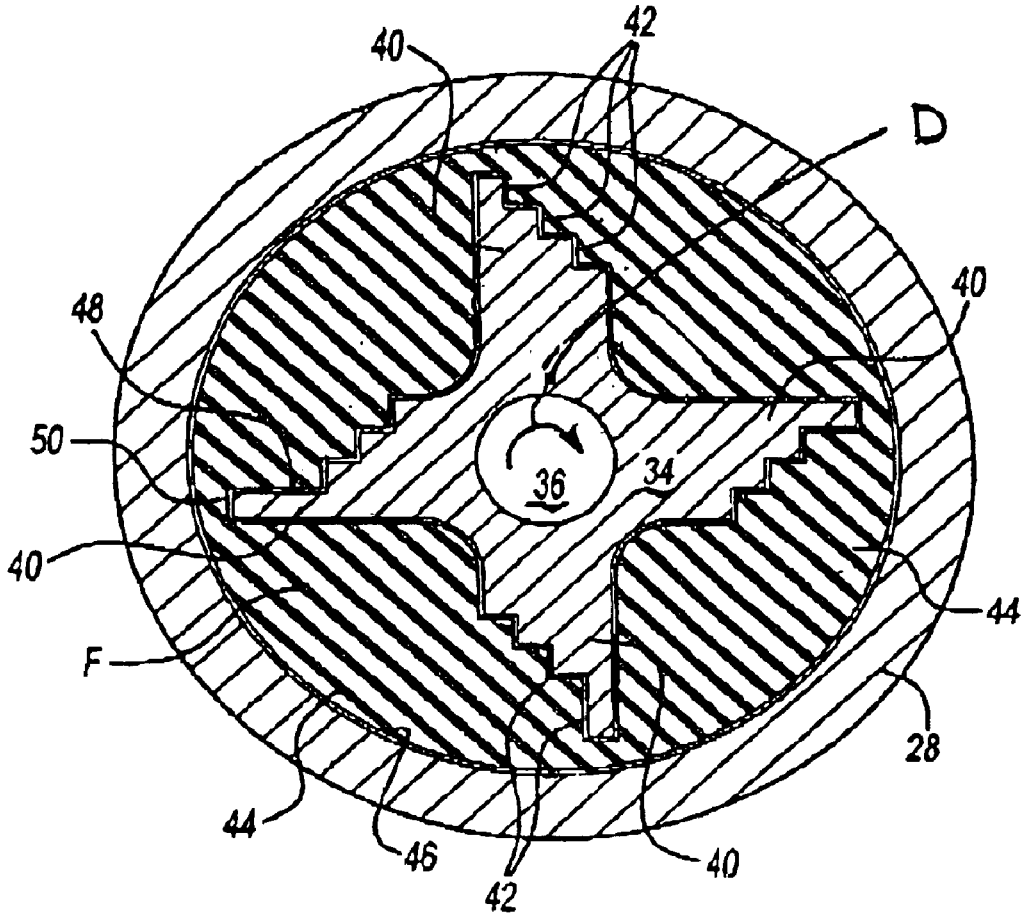
FIG. 3 is a sectional view of a mixer taken along line 3—3 of FIG. 2.

Referring to FIG. 3, each of the vanes 40 includes a plurality of steps 42. The steps 42 are located upon the leading side of the vanes 40. That is, the mixer is rotated in a first direction (illustrated by arrow D) and the steps 42 lead the direction of rotation D. The steps 42 preferably step down as they approach the inner diameter of the mix chamber 28. It should be understood that the term "step" includes other than perpendicularly related projections and that other projections which extend from the vanes and serve to agitate the fluid material components will also benefit from the present invention.

Figure 4:
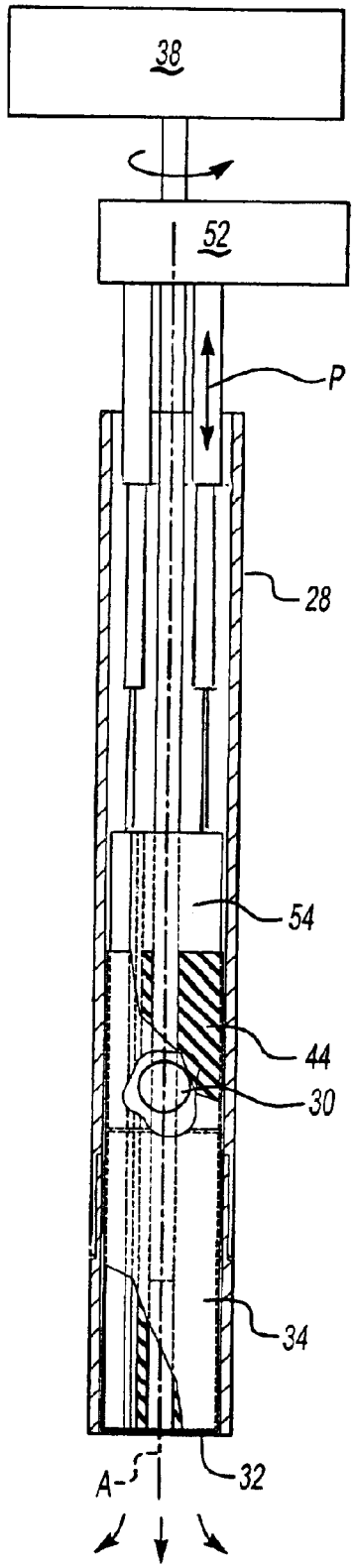
FIG. 4 is an expanded partial sectional view of a mix head assembly in a extended position.

The steps 42 define multiple line contacts with the multiple fluid material components (illustrated schematically at F; FIG. 4) within the mix chamber 28. As the mixer 34 is rotated within the mix chamber 28, interaction of the fluid material with the sequence of steps 42 rapidly mixes the multiple fluid material components therein. In other words, the fluid material components F will tend to be driven outward toward the inner diameter of the mix chamber 28 while being agitated along the series of steps 42.

A plunger 44 (also illustrated in FIG. 1) is movably mounted in the mix chamber 28 for movement along axis A. The plunger 44 defines an outer diameter 46 which closely fits within the inner diameter 44 of the mix chamber 28 and an inner configuration 48 which closely fits over the mixer 34. Preferably, the inner configuration 48 closely matches the outer configuration 50 of the mixer 34. The mixer is manufactured of a metallic material and the plunger 44 is manufactured of a non-metallic material to minimize friction therebetween, however, the reverse will also benefit herefrom.

A plunger actuator (illustrated schematically at 52; FIG. 1) drives the plunger 44 along axis A (illustrated by double headed arrow P) such that the fluid material components F are driven out of the mix chamber 28 (FIG. 4). As the plunger 44 is driven toward the output port 32, the plunger 44 simultaneously cleans any fluid material remnants therefrom. That is, the plunger 44 scrapes the fluid material off the mixer 34 such that no remnants remain within the mix chamber 28. The necessity of flushing between injection cycles is therefore eliminated as the plunger need only be cycled up and down. Cycle time for production and expense of each finished article is thereby decreased.

Figure 5:
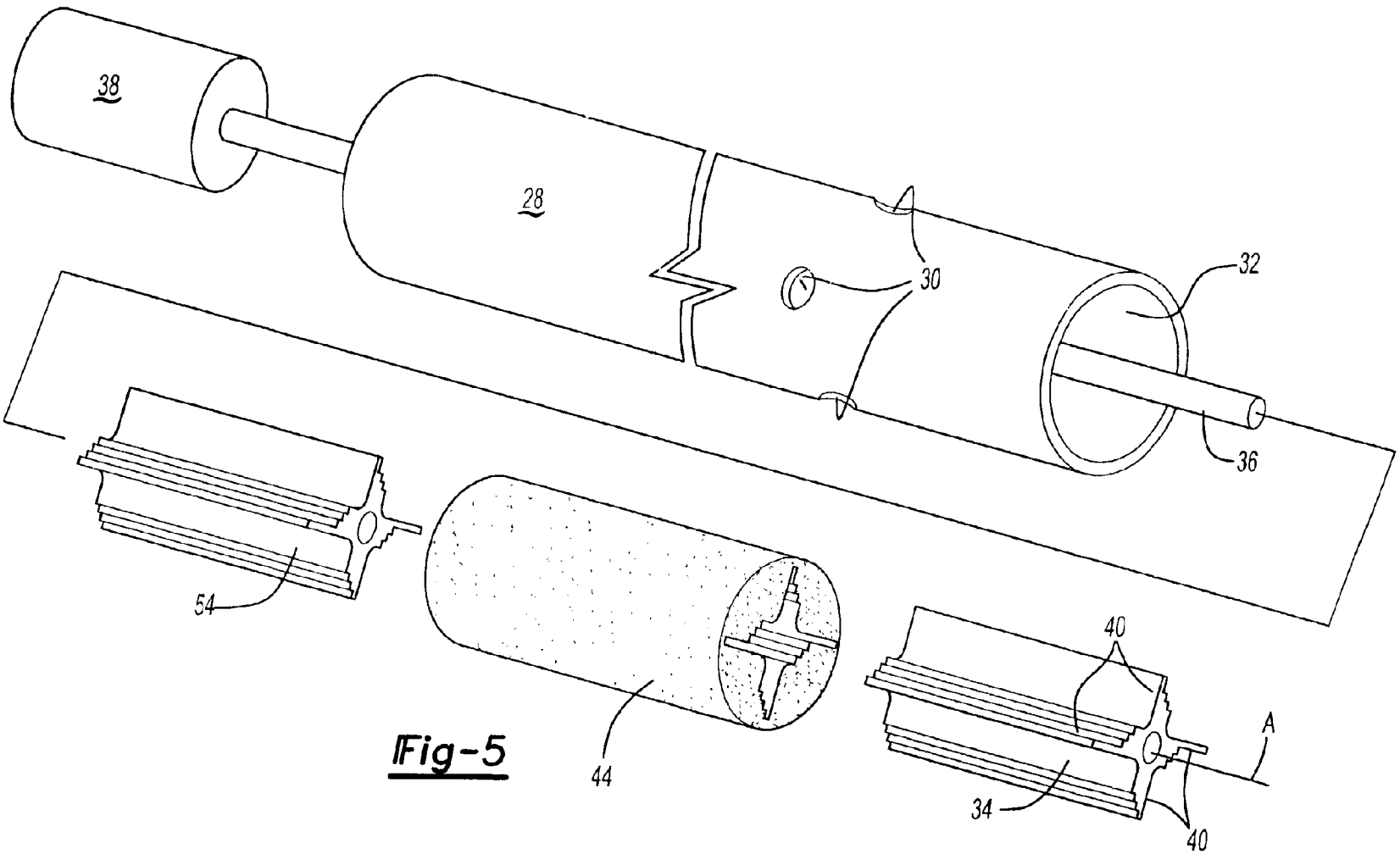
FIG. 5 is an exploded view of the mixer of the mix head assembly according to the present invention.

Referring to FIG. 5, a fixed mixer 54 preferably fixed within the mix chamber 28 to guide the mixer 34 along axis A. The input ports 30 are preferably arranged adjacent the fixed mixer 54. The fixed mixer 54 defines an outer configuration identical to that of the mixer 34 such that the fixed mixer 54 operates as a plug when the plunger 44 is retracted to contain the fluid material opposite the output port 32. Moreover, the mixer 34 need only be rotationally aligned with the fixed mixer 54 prior to actuation of the plunger 44. Sensors (not shown) in communication with the controller 23 (FIG. 1) are located on the fixed mixer 54 to assure alignment between the fixed mixer 54 and the mixer 34 prior to activation of the plunger 44.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A mix head assembly for a molding system comprising:

a mixer chamber having an output port, said mixer chamber defining an axis;

a rotatable mixer mounted within said mixer chamber, said rotatable mixer rotatable about said axis;

a plunger movably mounted within said chamber, said plunger movable along said axis to telescope over said mixer; and a rotationally fixed mixer said plunger movable along said axis toward said output port to telescope over said fixed mixer prior to telescoping over said rotatable mixer.

2. The mix head assembly as recited in claim 1, wherein said rotatable mixer comprises a plurality of vanes extending perpendicular to said axis.

3. The mix head assembly as recited in claim 2, wherein said plurality of vanes extend along a longitudinal length of said rotatable mixer.

4. The mix head assembly as recited in claim 2, wherein each of said plurality of vanes define a plurality of steps.

5. The mix head assembly as recited in claim 3, wherein said plurality of steps are located on one side of each of said plurality of vanes.

6. The mix head assembly as recited in claim 4, wherein said one side of each of said plurality of vanes leads a direction of rotation of said rotatable mixer.

7. The mix head assembly as recited in claim 1, wherein an inner configuration of said plunger corresponds with an outer configuration of said rotatable mixer.

8. The mix head assembly as recited in claim 1, further comprising a shaft extending along said axis, said airs shaft rotatably driving said rotatable mixer.

9. The mix head assembly as recited in claim 8, wherein said plunger moves relative to said shaft.

10. The mix head assembly as recited in claim 1, wherein said chamber defines an input port adjacent said rotationally fixed mixer.

11. A mix head assembly for a molding system comprising:

a mixer chamber having an output port, said mixer chamber defining an axis;

a rotatable mixer mounted within said mixer chamber, said rotatable mixer rotatable about said axis;

a plurality of vanes extending perpendicular to said axis;

a plurality of steps located on a leading side of each of said plurality of vanes; and a plunger movably mounted within said chamber, said plunger movable along said axis to telescope over said rotatable mixer; and a rotationally fixer mixer, said plunger movable along said axis toward said output port to telescope over said rotationally fixed mixer prior to telescoping over said rotatable mixer.

12. The mix head assembly as recited in claim 11, wherein said plurality of vanes extend along a longitudinal length of said rotatable mixer.

13. The mix head assembly as recited in claim 11, wherein said plurality of steps are located on one side of each of said plurality of vanes.

14. The mix head assembly as recited in claim 13, wherein said one side of each of said plurality of vanes leads a direction of rotation of said rotatable mixer.

15. The mix head assembly as recited in claim 11, wherein an inner configuration of said plunger corresponds with an outer configuration of said rotatable mixer.

* * * * *

UNITED STATES PATENT AND TRADEMARK OFFICE

CERTIFICATE OF CORRECTION

PATENT NO. : 6,726,355 B2
DATED : April 27, 2004
INVENTOR(S) : Li Preti et al.

It is certified that error appears in the above-identified patent and that said Letters Patent is hereby corrected as shown below:

Column 4,
Line 39, delete “airs” before “shaft” and after “said” (second occurrence).

Signed and Sealed this

Twenty-second Day of February, 2005

JON W. DUDAS
*Director of the United States Patent and Trademark Office*